US011644036B2

(12) United States Patent
Chang et al.

(10) Patent No.: US 11,644,036 B2
(45) Date of Patent: May 9, 2023

(54) ASSEMBLY STRUCTURE OF A MULTI-STAGE IMPELLER AND WHEEL HOUSING IN A SUBMERSIBLE PUMP

(71) Applicant: CHANG INDUSTRY CO., LTD., Taichung (TW)

(72) Inventors: Sheng-Fu Chang, Taichung (TW); Che-Wei Chang, Taichung (TW); Cheng-Lung Chang, Taichung (TW)

(73) Assignee: CHANG INDUSTRY CO., LTD., Taichung (TW)

( * ) Notice: Subject to any disclaimer, the term of this patent is extended or adjusted under 35 U.S.C. 154(b) by 65 days.

(21) Appl. No.: 17/460,576

(22) Filed: Aug. 30, 2021

(65) Prior Publication Data

US 2023/0018516 A1 Jan. 19, 2023

(30) Foreign Application Priority Data

Jul. 13, 2021 (TW) ..... 110125747

(51) Int. Cl.

| | |
|---|---|
| ***F04D 13/08*** | (2006.01) |
| ***F04D 29/044*** | (2006.01) |
| ***F04D 1/06*** | (2006.01) |
| ***F04D 29/42*** | (2006.01) |

(52) U.S. Cl.

CPC ..... *F04D 13/086* (2013.01); *F04D 1/063* (2013.01); *F04D 29/044* (2013.01); *F04D 29/426* (2013.01); *F05D 2240/60* (2013.01)

(58) Field of Classification Search

CPC ..... F04D 1/06; F04D 1/063; F04D 13/086; F04D 13/14; F04D 29/044; F04D 29/426; F04D 29/628

See application file for complete search history.

(56) References Cited

U.S. PATENT DOCUMENTS 2,954,739 A * 10/1960 Lung ..... F04D 13/10 415/199.3
4,726,734 A * 2/1988 Zientek ..... F04D 31/00 415/55.6
6,343,913 B1 * 2/2002 Ohsaki ..... F04D 29/426 415/199.2

FOREIGN PATENT DOCUMENTS

TW 456464 B 9/2001

* cited by examiner

*Primary Examiner* — Kenneth J Hansen
(74) *Attorney, Agent, or Firm* — WPAT, P.C

(57) ABSTRACT

An assembly structure of a multi-stage impeller and wheel housing for use in a submersible pump that includes a connecting seat having a drainage channel, shaft, intermediate unit which has a wheel housing, inner guide cover, and impeller. The wheel housing has a spacer, with an upper ring housing and lower ring canopy extending upward and downward, respectively, along the perimeter of the spacer. The intermediate unit has the upper ring housing connected to the canopy of the connecting seat by a swivel snap structure. A bottom unit has a bottom impeller and bottom wheel housing, which has a water suction port, a bottom plate and a bottom ring housing that extends upward along the perimeter of the bottom plate. A bottom ring canopy of an intermediate unit is connected by a rotating snap structure, and the bottom ring housing is pressed by a sealing ring.

5 Claims, 7 Drawing Sheets

ASSEMBLY STRUCTURE OF A MULTI-STAGE IMPELLER AND WHEEL HOUSING IN A SUBMERSIBLE PUMP

FIELD OF THE DISCLOSURE

The present disclosure relates in general to a submersible pump, and more particularly to an assembly structure of a multi-stage impeller and wheel housing in the submersible pump.

BACKGROUND OF THE DISCLOSURE

Taiwan Patent No. 456464 (TW456464U) discloses a fixing structure by combining a shaft and impeller. The main focus of the technology in TW45646U relates to a simple structure of a shaft and impeller, and the simple operation with respect to the relative locking and the easy of disassembly.

In TW45646U, a number of wheel housing units overlap each other, and each wheel housing unit is equipped with an impeller. These wheel housing units are tightened by a number of bolts (see the rightmost side of FIG. 3 of TW45646U showing a fixing bolt) all at once. Although such tightening method can achieve the effect of affixing the wheel housing units, still, after a period of use, the tightness of the assembly between each wheel housing unit will result due to the aging or deformation of the components themselves, thereby producing gaps, which then allow for an easy leakage and loss of pressure due to the gaps, and thus create the problem of insufficient driving pressure.

SUMMARY OF THE DISCLOSURE

It is therefore an object of the present disclosure to provide an assembly structure of a multi-stage impeller and wheel housing for use in a submersible pump, with each wheel housing inter-connected or overlapped without using any bolt for tightening.

It is a further object to provide an assembly structure of a multi-stage impeller and a wheel housing for use in a submersible pump in which the shaft rod is combined with the drive shaft of the motor, so that the number of wheel housings and length of the combined shaft can be determined in accordance with a desired usage of certain depth.

To achieve the above-mentioned objects, the present disclosure provides an assembly structure with a multi-stage impeller and wheel housing for use in an immersion pump driving by a motor. Specifically, the assembly structure of the multi-stage impeller and wheel housing for use in the immersion pump includes a connecting seat for connection to the motor. The bottom end of the connecting seat has a cover facing downward, and a ring canopy extending downward along the perimeter of the cover. The connecting seat has a shaft bore in the cover so that the drive shaft of the motor can pass through. The connecting seat also has a drainage channel with one end open to the cover and the other end open to one side of the connecting seat. A shaft rod with one end fixed to and driven by the drive shaft rotates along the axis of the shaft rod. An intermediate unit having a wheel housing, inner guide cover and impeller. The wheel housing has a spacer. An upper ring housing extends upward along the perimeter of the spacer, and a lower ring canopy extends downward along the perimeter of the spacer. The spacer has a perforation for the shaft rod to pass through, and the perforation has an aperture larger than the diameter of the shaft rod so that the perforated edge of the perforation is separated from the shaft rod by a predetermined distance. The inner guide cap being located below the spacer and having a cover plate and a plural guide plate on the top surface of the cover plate. The plural guide plate being located on the top surface of the cover plate, and the plural guide plate being located on the top surface of the cover plate. The inner guide cover is located below the spacer and has a cover plate and a plural guide plate at the top of the cover plate, and the plural guide plate is connected to a ring foot so that the ring foot surrounds the cover plate and a gap is retained between the cover plate and the ring foot, and the cover plate has a central through-hole for the shaft rod to pass through, and the diameter of the through-hole is larger than the diameter of the shaft rod so that the edge of the through-hole is separated from the shaft rod by a predetermined distance. The intermediate impeller is fixed to the shaft rod and is located in the spacer and is driven by the shaft rod to rotate. The intermediate unit with the upper ring housing and the ring canopy of the connecting seat joined by a rotating snap structure, and the upper ring housing and the connecting seat are pressed against each other by a sealing ring which fills the gap between the upper ring housing and the connecting seat to prevent the passage of liquid. A bottom unit has a bottom wheel housing and a bottom impeller having a bottom plate and a bottom ring housing that extends upwardly along the circumference of the bottom plate, the bottom impeller having a bottom ring housing fixed to the shaft and a bottom impeller that extends upwardly along the circumference of the bottom plate. The bottom unit also has a bottom plate, and a bottom ring shell extending upward along the circumference of the bottom plate. The bottom impeller is fixed to the shaft and located above the bottom plate, and is driven by the shaft rod to rotate, the bottom unit is connected to the lower ring canopy of the intermediate unit by a rotating snap structure, and the bottom unit has a sealing ring between the bottom ring shell and the ring foot, and is pressed against each other. The bottom wheel housing also has a water suction port.

In this way, the present disclosure allows the intermediate unit and the bottom unit to be connected or overlapped without the use of fixing bolts for tightening. Additionally, the shaft rod of the disclosure is assembled with the drive shaft of the motor, so the number of intermediate units and the length of the shaft rod can be determined according to the desired use based on certain depth, along with the additional intermediate unit which is defined as the extended intermediate unit.

BRIEF DESCRIPTION OF THE DRAWINGS

In order to illustrate the technical features of the present disclosure in detail, an exemplary embodiment is illustrated with drawings, wherein.

DETAILED DESCRIPTION OF THE EXEMPLARY EMBODIMENT

Figure 1:
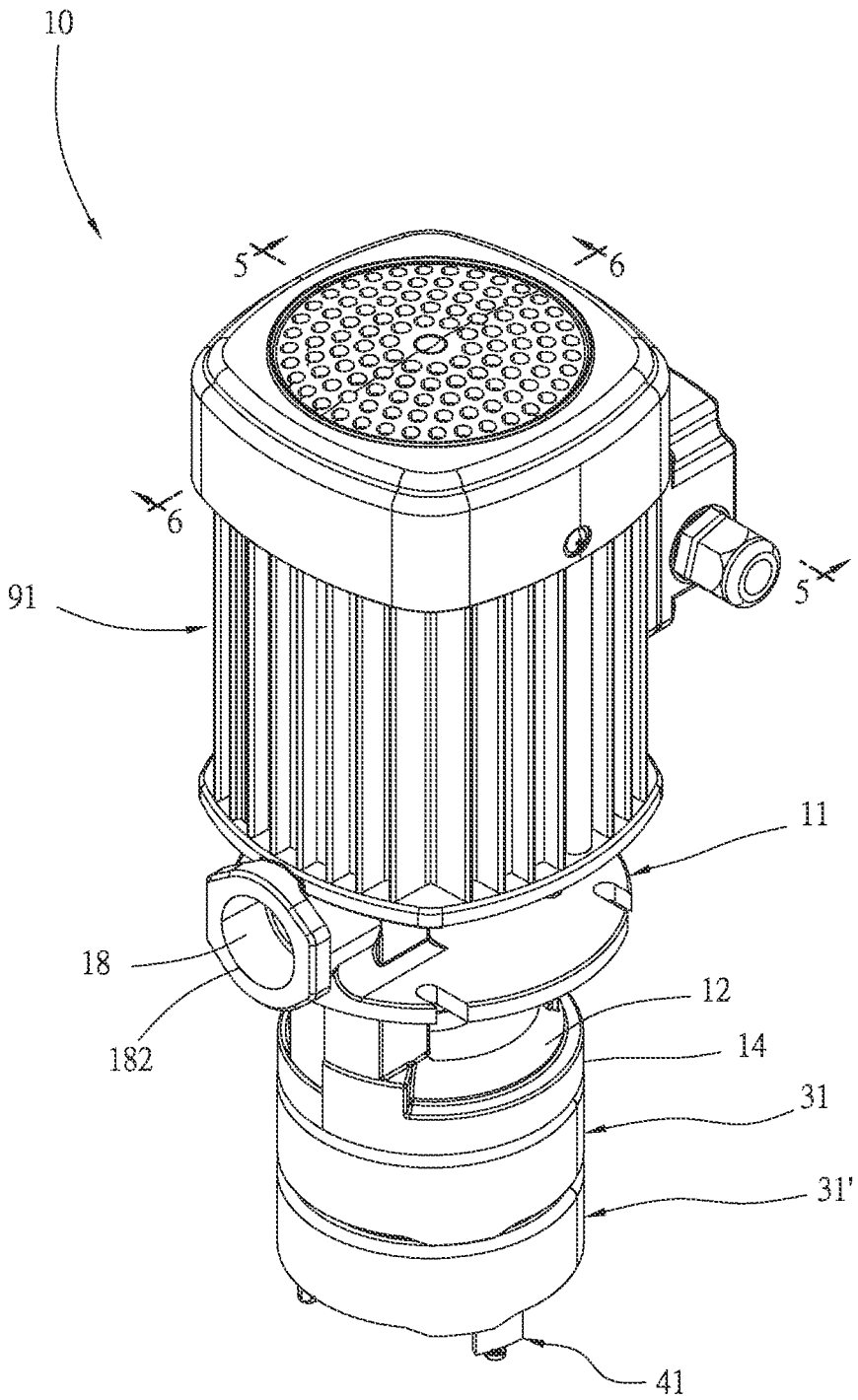
FIG. 1 is a composite elevation of the exemplary embodiment of the present disclosure.
Figure 2:
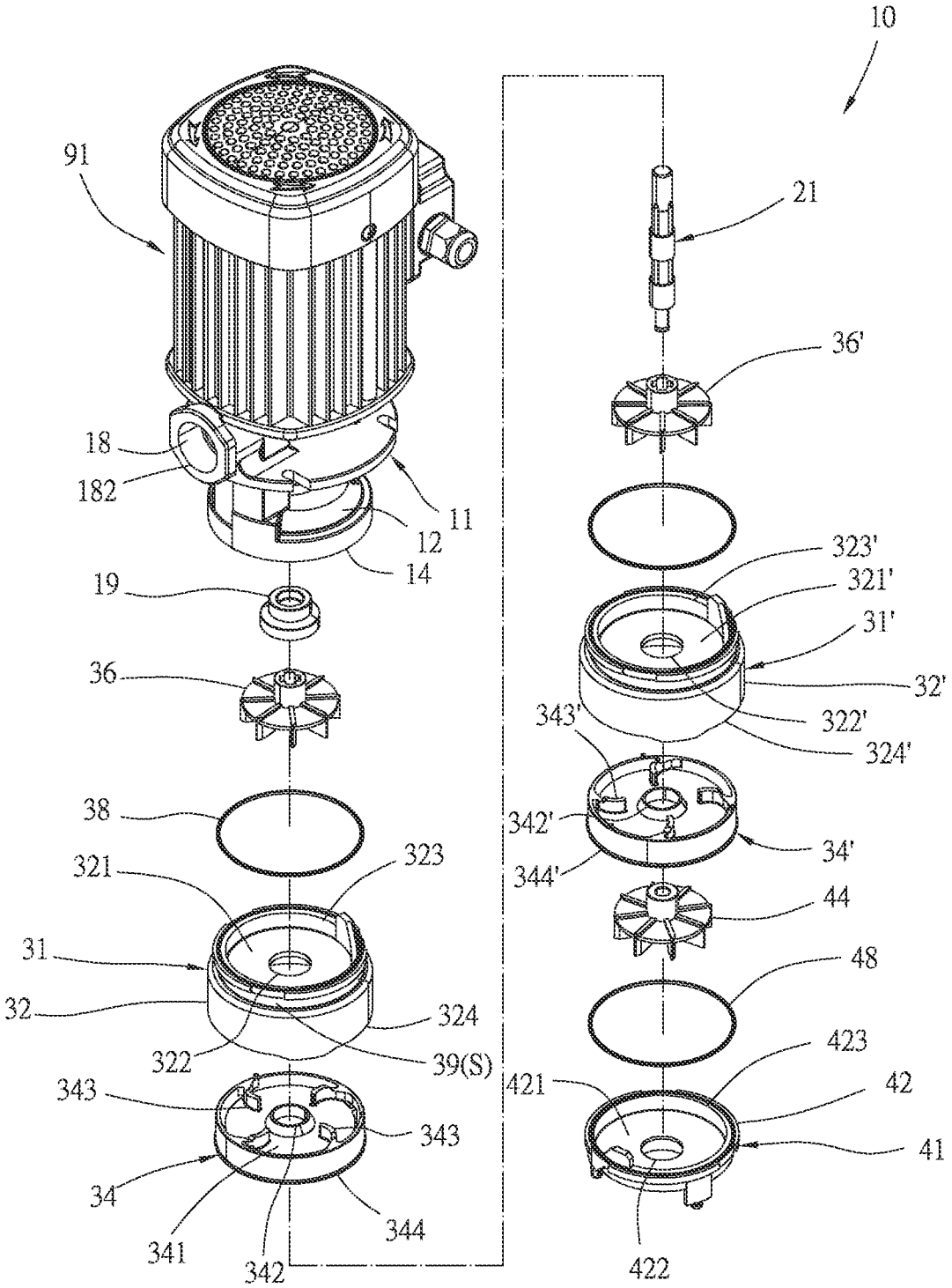
FIG. 2 is an exploded view of the exemplary embodiment of the present disclosure.
Figure 3:
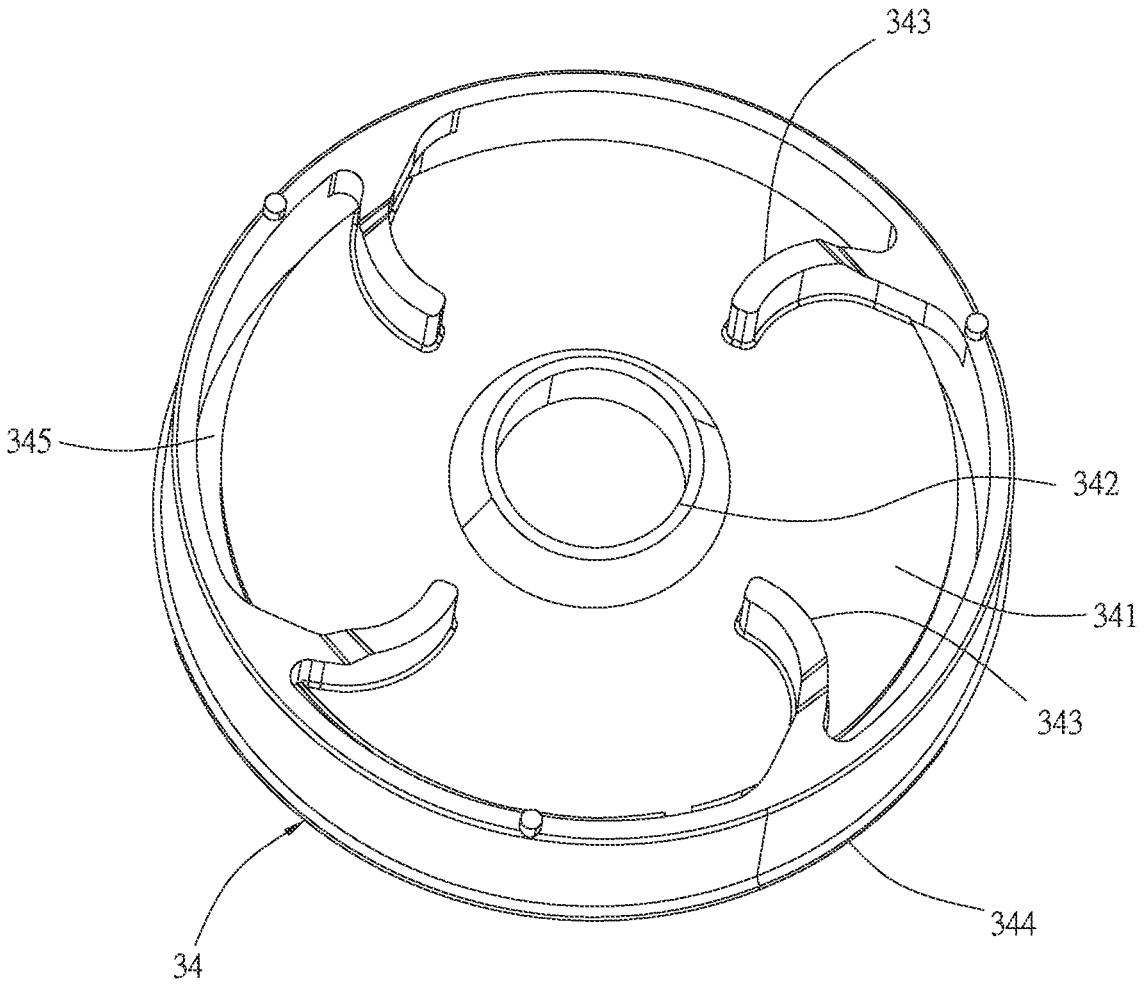
FIG. 3 is an enlarged view of a partial component of the exemplary embodiment of the present disclosure, showing the structure of the inner conductive cover.
Figure 4:
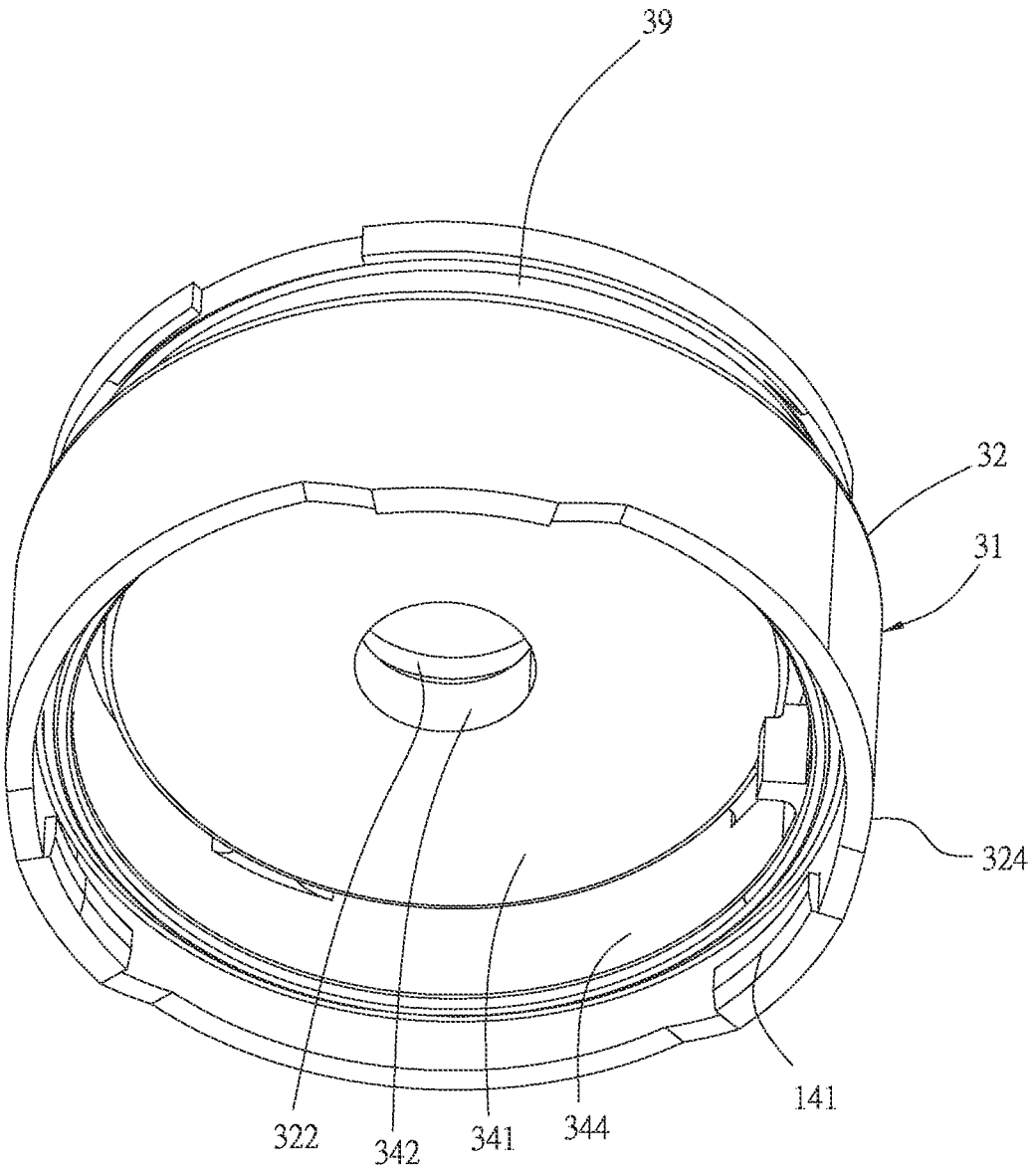
FIG. 4 is an enlarged view of another partial component of the exemplary embodiment of the present disclosure, showing the three-dimensional state of the wheel housing of the intermediate unit and the bottom view angle of the inner guide cover.

In order to illustrate the technical features of the present disclosure in detail, the following exemplary embodiment is cited and illustrated with accompanying drawings, among others.

As shown in FIGS. 1 to 7, an exemplary embodiment of the present disclosure supports an assembly structure 10 of a multi-stage impeller and wheel housing for use in an immersion pump to be driving by a motor 91. The assembly structure 10 of the multi-stage impeller and wheel housing for use in the immersion pump is mainly composed of a connecting seat 11, shaft rod 21, intermediate unit 31 and bottom unit 41.

Specifically, the connecting seat 11 is connected to the motor 91, and the bottom end of the connecting seat 11 has a cover 12 facing downward and a ring canopy 14 extending downward along the periphery of the cover 12, and the connecting seat 11 has a shaft bore 16 through the cover 12, and the shaft bore 16 is for the drive shaft 92 of the motor 91 to pass through. The connecting seat 11 also has a drainage channel 18, with one opening 181 at one end of the drainage channel 18 through the cover 12 and another opening 182 at the other end on one side of the connecting seat 11. The drive shaft 92 is provided with a rubber sleeve 19, which is located above and covers the shaft bore 16, so that the liquid can be blocked from spraying upward when the liquid is driven upward from the shaft bore 16, so that the liquid can flow out to the periphery because of the block.

The shaft rod 21 is fixed at one end of the drive shaft 92 and is driven by the drive shaft 92 to rotate along the long axis of the shaft rod 21. In practice, the bottom end of the drive shaft 92 is provided with a recess 921, and the shaft rod 21 is tightly coupled to the drive shaft 92 with its top end penetrating into the recess 921 for a length of time. The connection is carried out by the technique of combining the shaft rod 21 with the drive shaft 92.

The intermediate unit 31 has a wheel housing 32, an inner guide cover 34, and an impeller 36. The wheel housing 32 has a spacer 321, with an upper ring housing 323 extending upward along the perimeter of the spacer 321, and a lower ring canopy 324 extending downward along the perimeter of the spacer 321. The spacer 321 has a perforation 322 for allowing the shaft rod 21 to pass through, and the diameter of the perforation 322 is larger than the diameter of the shaft rod 21 so that the perforated edge of the perforation 322 is separated from the shaft rod 21 by a predetermined distance. The inner guide cap 34 is located below the spacer 321 and has a cover plate 341 and multiple guide plates 343 on the top surface of the cover plate 341. The guide plates 343 are each connected to a ring foot 344 so that the ring foot 344 surrounds the cover plate 341 and retains a space between the ring foot 344 and the cover plate 341. The cover plate 341 has a through hole 342 for the shaft rod 21 to pass through, and the aperture of the hole 342 is larger than the diameter of the shaft rod 21 so that the aperture edge of the hole 342 is separated from the shaft rod 21 by a predetermined distance. The impeller 36, which is located above the spacer 321, is fixed to and driven by the shaft rod 21 for rotation thereof. The intermediate unit 31 is connected with the ring canopy 14 of the connecting seat 11 through a rotating snap structure S. The upper ring shell 323 and the connecting seat 11 are pressed against each other with a sealing ring 38, which fills the gap 345 between the upper ring shell 323 and the connecting seat 11 to prevent the liquid from passing through.

In this embodiment, the rotating snap structure S has the upper ring shell 323. The ring canopy 14 is provided with inwardly projecting tabs 141, and the outer wall is provided with snap recesses 39. The tabs 141 are used to mate with the snap recesses 39 to form a rotating snap state. In practice, the snap recesses 39 have an inlet and an inclined section for tightening, and a horizontal section for maintaining a fixed state, a structure that is directly understood by those with ordinary knowledge in the art, and therefore not described in detail. In addition, the guide plates 343 may be set in a form extending in an arc toward the center, so as to produce a cyclonic effect when guiding the liquid flow toward the center.

Figure 7:
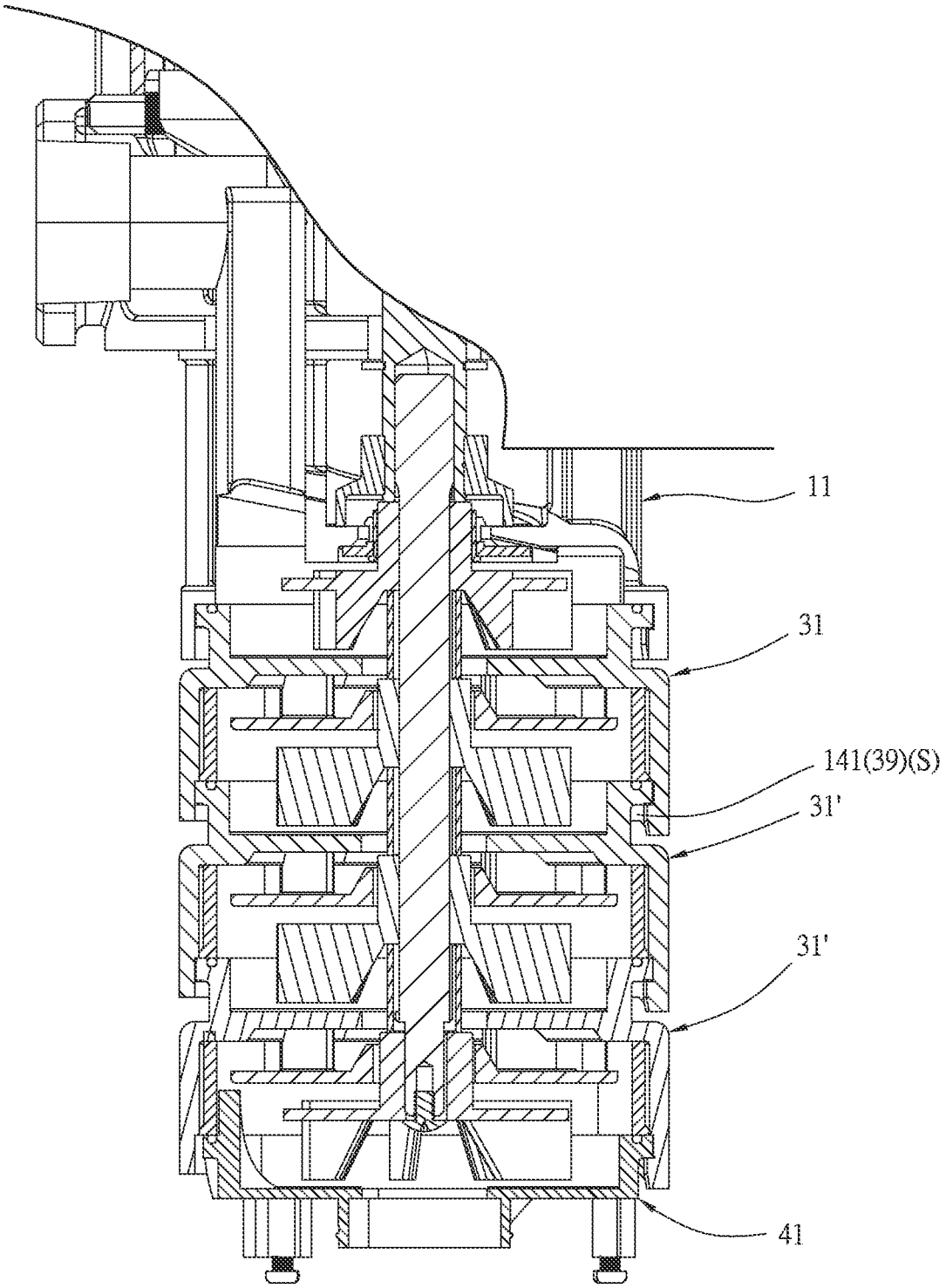
FIG. 7 is a cross-sectional view of the exemplary embodiment of the present disclosure with an additional extended intermediate unit as compared to FIG. 5.

In this embodiment, there is an additional extension intermediate unit 31', which has the same structure as the intermediate unit 31 in that a wheel housing 32', an inner guide cover 34', and an impeller 36', and the upper ring shell 323' are joined to the lower ring 324 of the intermediate unit 31 by a rotating snap structure S, while the sealing ring 38 is further provided therebetween. The structure and setting relationship of the impeller 36' are the same as that of the wheel housing 32, inner guide cover 34, and impeller 36 of the intermediate unit 31, except that such is superimposed over each other in terms of position, and therefore a detailed structure thereof is not repeated, with the corresponding components marked with the same mark but adding a punctuation mark (i.e., the apostrophe symbol ') to show the difference. In practice, this additional extended intermediate unit 31' is optional. If more than one is added, then the extended intermediate units 31' are overlapped as shown in FIG. 7, which is a state where two extended intermediate units 31' are added. If none is added, then the bottom unit 41' is directly combined with the intermediate unit 31. Therefore, the height of the top and bottom overlapping of the disclosure can be determined according to the user's needs. After deciding the number of additional extension units 31', the shaft rod 21 can be correctly assembled by selecting the corresponding length without encountering the problem of the shaft rod 21 being too long or too short.

The bottom unit 41 has a bottom wheel housing 42 and a bottom impeller 44. The bottom wheel housing 42 has a bottom plate 421, with the bottom ring housing 423 extending upward along the periphery of the bottom plate 421. The bottom impeller 44 is fixed to the shaft rod 21, and located above the bottom plate 421. The bottom impeller 44 is driven by the shaft rod 21 to rotate, and the bottom unit 41 is connected to the lower ring 324' of the extended intermediate unit 31' by a rotating snap structure S, with the bottom ring housing 423 of the bottom unit 41 connected to the ring foot 344' of the extended intermediate unit 31' by a rotating snap structure S. The bottom unit 41 is connected to the lower ring canopy 324' of the extended intermediate unit 31' by a rotating snap structure S, and the bottom unit 41 has a sealing ring 48 between the bottom ring shell 423 and the ring foot 344' of the extended intermediate unit 31' and is pressed against each other. The bottom wheel housing 42 also has a water suction port 422.

The aforementioned paragraphs described the structure of the exemplary embodiment, with the forthcoming paragraphs describing the operational state of the exemplary embodiment.

Figure 5:
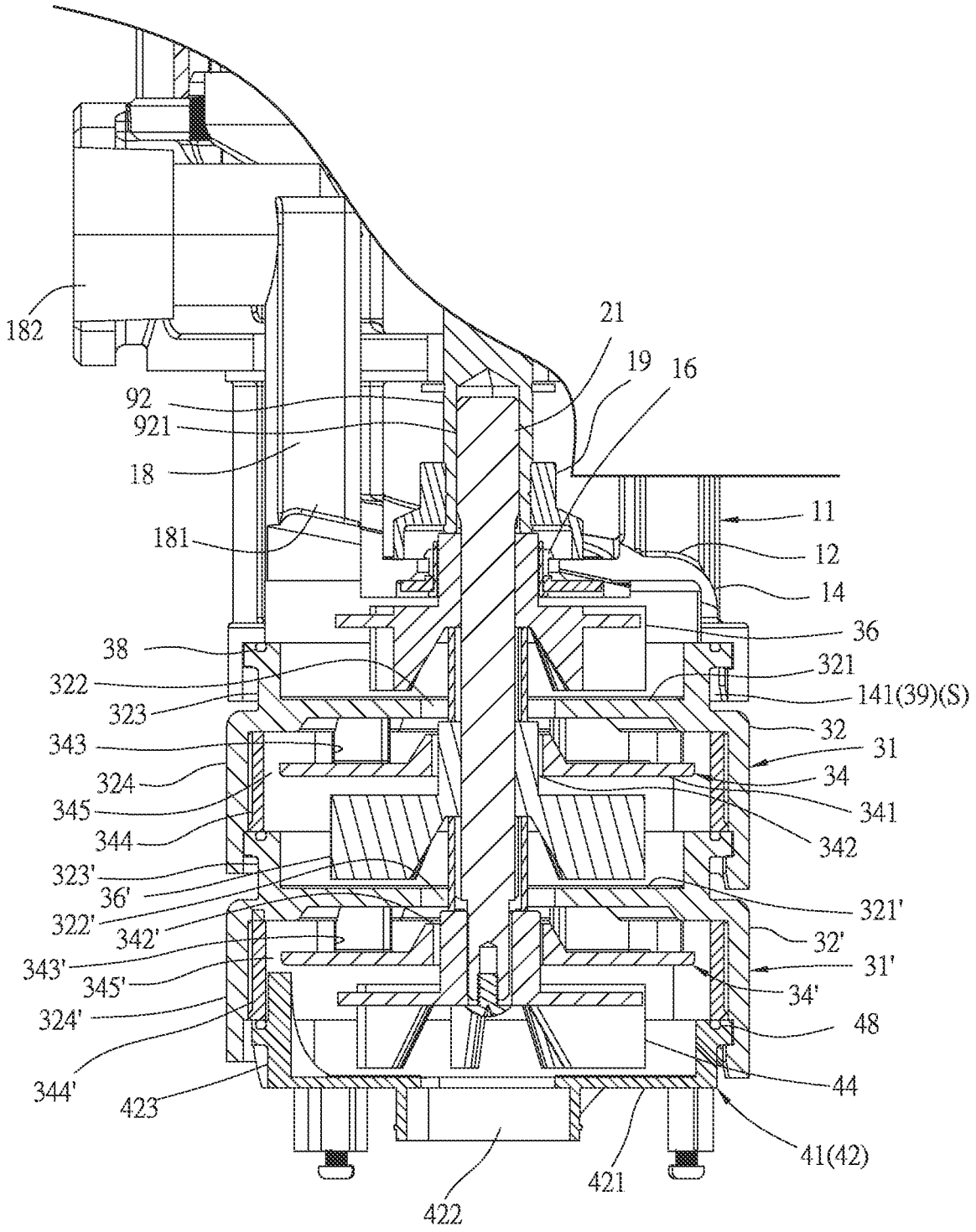
FIG. 5 is a cross-sectional view along the cutting plane line 5-5 in FIG. 1.
Figure 6:
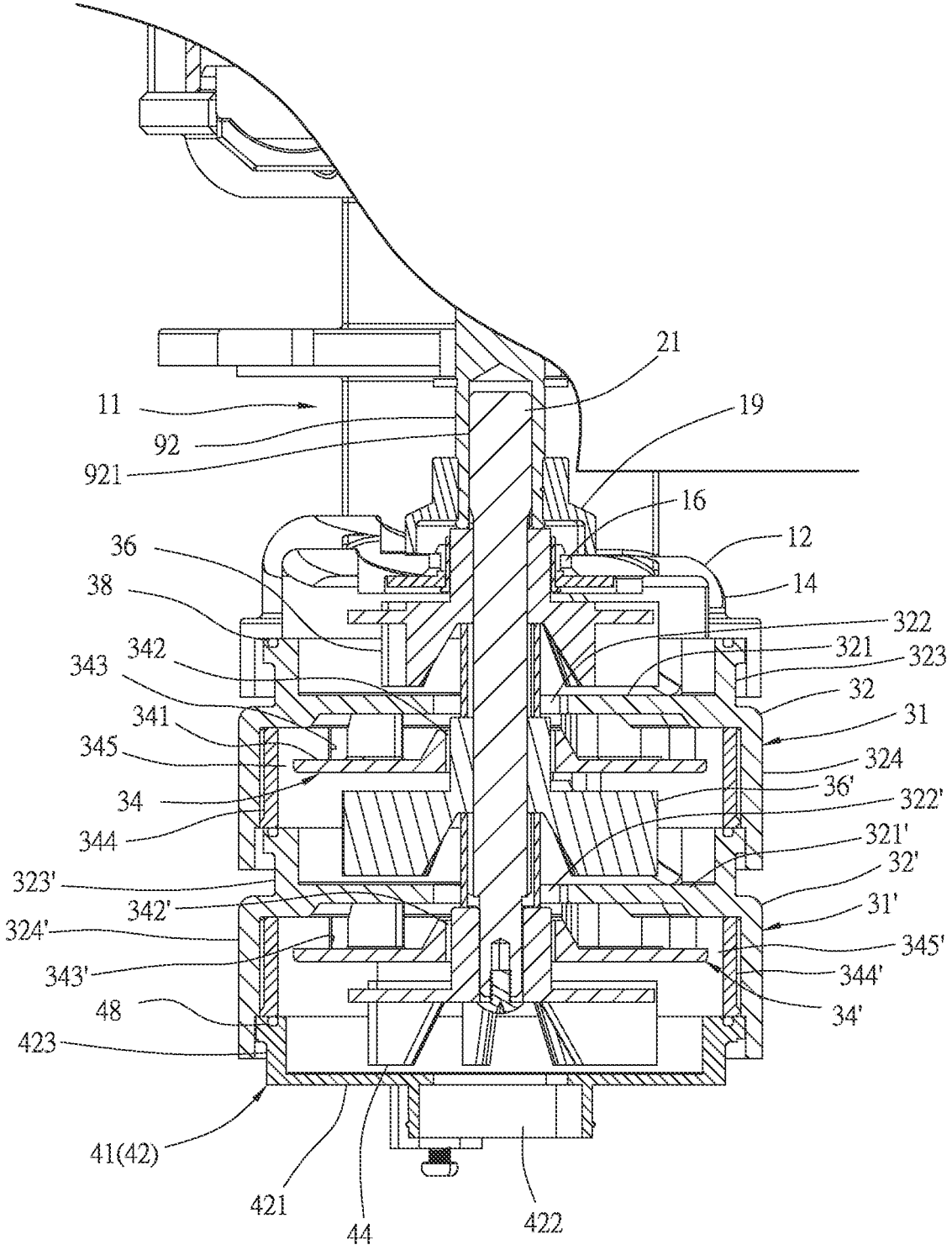
FIG. 6 is a cross-sectional view along the cutting plane line 6-6 in FIG. 1.

Although not shown in FIGS. 5 and 6 to avoid confusion and difficulty in identification, water can be used as the liquid in the exemplary embodiment. When pumping water, at least the water suction port 422 of the bottom unit 41 and the bottom impeller 44 of the disclosure should be placed under the water surface, and the water will enter the bottom wheel housing 42 through the water suction port 422. After the motor 91 is driven, the drive shaft 92 drives the shaft rod 21 to rotate, which in turn drives the intermediate unit 31, the impeller 36' of the extended intermediate unit 31' and the bottom impeller 44 to rotate, which in turn drives the water inside the bottom wheel housing 42 to move around, and the water is forced to move upward and pass through the inner guide of the extended intermediate unit 31'. The water is forced to move upward and pass through the gap 345' and the through hole 342' of the inner guide cover 34' of the extended intermediate unit 31', and is located above the inner guide cover 34', and is then guided by the multiple guide plates 343'. The water is then driven by the impeller 36 of the intermediate unit 31 and moved upward in the same manner to the lower part of the cover 12, and then discharged through one opening 181 of the drainage channel 18 at the cover 12 and to the other opening 182 at the other end.

If the driving force is too strong, water may also overflow upward from the shaft bore 16. At this point, the water will be stopped by the rubber sleeve 19 and will not move upward to the motor 91, but instead will flow outward.

From the above description, it is clear that the disclosure basically has an intermediate unit 31 between the connecting seat 11 and the bottom unit 41. When the length is increased, one or more extension intermediate units 31' can be added. After the number of extended intermediate units 31' is determined, the shaft rod 21 of the corresponding length can be selected to complete the finished product as required by the user. During assembly, the intermediate unit 31, the extended intermediate unit 31' and the bottom unit 41 are combined by means of a rotary snap joint. In this way, the disclosure can achieve the following results.

First, the disclosure allows the intermediate unit 31, each of the extended intermediate unit 31' and the bottom unit 41 to be rotatably fastened to each other, i.e., to be connected by their own structure, without the need to use fixing bolts for tightening as previously implemented in the conventional field. Next, when the shaft rod 21 and the drive shaft 92 of the present disclosure are combined, the manufacturer can determine how many extension units 31' are needed based on the depth of used as required by the user, and accordingly select the shaft rod 21 of suitable length after the number of extension units 31' needed is determined. In this way, the manufacturer only needs to stock the extended intermediate unit 31' and the shaft rod 21 of different lengths to meet the different length requirements, thus reducing the inventory pressure on the manufacturer.

As shown in FIGS. 1-7, the assembly structure of the multi-stage impeller and wheel housing for use in the submersible pump includes a submersible pump 10; connecting seat 11; cover 12; ring canopy 14; shaft bore 16; drainage channel 18; rubber sleeve 19; shaft rod 21; intermediate unit 31; wheel housing 32; inner guide cover 34; impeller 36; seal ring 38; snap recesses 39; bottom unit 41; bottom wheel housing 42; bottom impeller 44; seal ring 48; motor 91; drive shaft 92; tab 141; openings 181 and 182; spacer 321; perforation 322; upper ring shell 323; lower ring canopy 324; cover plate 341; through hole 342; guide plate 343; ring foot 344; gap 345; bottom plate 421; water suction port 422; bottom ring housing 423; recess 921; swivel snap structure S; extension intermediate unit 31'; wheel housing 32'; inner guide cover 34'; impeller 36'; spacer 321'; perforations 322'; upper ring shell 323'; lower ring canopy 324'; through hole 342'; guide plate 343'; ring foot 344'; and clearance 345'.

The present disclosure has been described with reference to the exemplary embodiment, and such description is not meant to be construed in a limiting sense. It should be understood that the scope of the present disclosure is not limited to the above-mentioned embodiment, but is limited by the accompanying claims. It is, therefore, contemplated that the appended claims will cover all modifications that fall within the true scope of the present disclosure. Without departing from the object and spirit of the present disclosure, various modifications to the embodiments are possible, but they remain within the scope of the present disclosure, will be apparent to persons skilled in the art.

What is claimed is:

1. An assembly structure of a multi-stage impeller and a wheel housing for a submersible pump driven by a motor comprising:

a connecting seat for connecting to the motor, wherein the connecting seat has a cover facing downward at a bottom end and a ring canopy extending downward along a perimeter of the cover;

a shaft rod with one end fixed to one end of a drive shaft of the motor and driven by the drive shaft to rotate along a long axis of the shaft rod;

an intermediate unit having an intermediate wheel housing, an inner guide cover, and an intermediate impeller; and a bottom unit having a bottom wheel housing and a bottom impeller, wherein the bottom wheel housing has a bottom plate and a bottom ring housing, and the bottom ring housing extends upwardly along a circumference of the bottom plate;

wherein the connecting seat has a shaft bore in the cover for allowing the drive shaft of the motor to pass through, and the connecting seat further has a drainage channel having a first opening on the cover and a second opening on a side of the connecting seat;

wherein the intermediate wheel housing has a spacer, an upper ring housing extending upwardly along a perimeter of the spacer, and a lower ring canopy extending downwardly along the perimeter of the spacer, which has a perforation for the shaft rod to pass through, and the perforation has an aperture larger than a diameter of the shaft rod so that a perforated edge of the perforation is separated from the shaft rod by a pre-determined distance;

wherein the inner guide cover is located below the spacer, has a perforation for the shaft rod to pass through, and has a cover plate and a plurality of guide plates on a top surface of the cover plate, and the plurality of guide plates are connected to a ring foot so that the ring foot surrounds the cover plate;

wherein a gap is retained between the cover plate and the ring foot, and the cover plate has a central through-hole for the shaft rod to pass through, and the central through-hole is larger than the diameter of the shaft rod so that an edge of the central through-hole is separated from the shaft rod by a predetermined distance, the intermediate impeller is fixed to the shaft rod and is located in the spacer, and is driven by the shaft rod to rotate;

wherein the intermediate unit with the upper ring housing and the ring canopy of the connecting seat is connected by a rotating snap structure, and the upper ring housing and the connecting seat are pressed against each other with a sealing ring which fills the gap between the upper ring housing and the connecting seat to prevent the passage of liquid; and wherein the bottom impeller is fixed to the shaft rod, positioned above the bottom plate, and driven by the shaft rod to rotate, the bottom unit is connected to the lower ring canopy of the intermediate unit by the rotating snap structure, the bottom ring housing of the bottom unit is pressed against the ring foot by a sealing ring, and the bottom wheel housing is provided with a water suction port.

2. The assembly structure of the multi-stage impeller and the wheel housing for use in the submersible pump according to claim 1, wherein at least one extended intermediate unit is provided between the intermediate unit and the bottom unit, has the same structure as the intermediate unit with a wheel housing, an inner guide cover, and an impeller, and wherein the upper ring housing is joined to the lower ring canopy of the intermediate unit by the rotating snap structure, and the bottom unit is joined to the lower ring canopy of the more than one extended intermediate unit by the upper ring housing by the rotating snap structure.

3. The assembly structure of the multi-stage impeller and the wheel housing for use in the submersible pump according to claim 1, wherein the rotating snap structure which connects the upper housing and the ring canopy is formed by structure wherein one of the upper ring shells and the ring canopy are provided with a plurality of tabs projecting inward, and the other is provided with a plurality of snap recesses on the outer wall, and the plurality of tabs is used to mate with the plural snap recesses.

4. The assembly structure of the multi-stage impeller and the wheel housing for use in the submersible pump according to claim 1, wherein the drive shaft is equipped with a rubber sleeve, which is located above and covers the shaft bore.

5. The assembly structure of the multi-stage impeller and the wheel housing for use in the submersible pump according to claim 1, wherein the bottom end of the drive shaft has a recess, and the shaft rod is fastened to the drive shaft with a top end penetrating into the recess at a predetermined length.

* * * * *